United States Patent [19]

Tajima

[11] Patent Number: 4,461,226

[45] Date of Patent: Jul. 24, 1984

[54] WAITING MEANS IN AN EMBROIDERING MACHINE

[75] Inventor: Ikuo Tajima, Nagoya, Japan

[73] Assignee: Tokai Kogyo Mishin Kabushiki Kaisha, Kasugai, Japan

[21] Appl. No.: 480,674

[22] Filed: Mar. 31, 1983

[30] Foreign Application Priority Data

Apr. 20, 1982 [JP] Japan ..... 57-66738
Jun. 28, 1982 [JP] Japan ..... 57-112242

[51] Int. Cl.[3] ..... D05C 3/02; D05B 27/20

[52] U.S. Cl. ..... 112/98; 112/221; 112/311; 112/321

[58] Field of Search ..... 112/98, 102, 221, 311, 112/320, 321

[56] References Cited

U.S. PATENT DOCUMENTS

| | | | |
|---|---|---|---|
| 2,604,860 | 7/1952 | Farber | 112/98 |
| 4,223,617 | 9/1980 | Upmeier et al. | 112/311 X |
| 4,274,345 | 6/1981 | Schneider et al. | 112/311 X |
| 4,296,703 | 10/1981 | Thompson | 112/311 X |

FOREIGN PATENT DOCUMENTS

| | | | |
|---|---|---|---|
| 105693 | 9/1899 | Fed. Rep. of Germany | 112/98 |
| 13108 | 8/1899 | United Kingdom | 112/98 |

*Primary Examiner*—H. Hampton Hunter
*Attorney, Agent, or Firm*—Dennison, Meserole, Pollack & Scheiner

[57] ABSTRACT

Disclosed herein is waiting means for use in an embroidering machine which has a head; a needle bar vertically movably carried in the forward end portion of the head and having a needle operatively connected thereto for forming embroidery stitches on a cloth; a nipple vertically movably carried in the forward end portion of the head in parallel relation with the needle bar, the nipple slidably receiving the needle bar therewithin and adapted to be lowered synchronously when the needle bar is lowered so as to press the cloth at the needle location where the needle passes through the cloth; and a presser foot vertically movably carried in the forward end portion of the head in parallel relation with the needle bar and the nipple, the presser foot, when the needle is raised, being adapted to be displaced horizontally so as to horizontally feed the cloth while pressing the cloth around the needle location. The waiting means comprises lifting means mechanically coupled to the top portion of the head and adapted to lift each of the needle bar, the nipple and the presser foot upwardly so as to bring each to a waiting position when the sewing operation is stopped.

4 Claims, 14 Drawing Figures

WAITING MEANS IN AN EMBROIDERING MACHINE

BACKGROUND OF THE INVENTION

The present invention relates to waiting means for an embroidering machine, and more particularly to such waiting means wherein for example when the sewing operation is stopped, a needle, a nipple and a presser foot are lifted from the site where sewing operation is carried out to wait for the subsequent sewing operation.

SUMMARY OF THE INVENTION

According to the present invention, there is provided waiting means for use in an embroidering machine which has a head; a needle bar vertically movably carried in the forward end portion of the head and having a needle operatively connected thereto for forming embroidery stitches on a cloth; a nipple vertically movably carried in the forward end portion of the head in parallel relation with the needle bar, the nipple slidably receiving the needle bar therewithin and adapted to be lowered synchronously when the needle bar is lowered so as to press the cloth at the needle location where the needle passes through the cloth; and a presser foot vertically movably carried in the forward end portion of the head in parallel relation with the needle bar and the nipple, the presser foot, when the needle is raised, being adapted to be displaced horizontally so as to horizontally feed the cloth while pressing the cloth around the needle location. The waiting means comprises lifting means mechanically coupled to the top portion of the head and adapted to lift each of the needle bar, the nipple and the presser foot upwardly so as to bring each to a waiting position when the sewing operation is stopped. In a preferred embodiment of the present invention, the lifting means includes a needle waiting lever, a nipple waiting lever, and a presser foot waiting lever, each of which levers operatively engaging with a cam for raising the needle bar, the nipple and the presser foot, respectively, when the sewing operation is stopped. In another embodiment, grooved cams are used to operatively engage with the waiting levers so that the fulcrum of swing of the respective levers is displaced to thereby adjust the upward movement from the top dead point of the needle, the nipple and the presser foot, respectively.

The present invention is directed to a modified mechanism for actuating the needle waiting lever, wherein the lifting means comprises a swing lever pivotally connected to the head for raising the needle bar when the sewing operation is stopped, the swing lever having a fulcrum of swing adapted for displacement; a main cam rotatably connected to the head and mechanically coupled to a source of rotational drive of the embroidering machine for normally reciprocating the needle bar; and an auxiliary cam rotatably connected to the head and mechanically coupled to a source of rotational drive of the embroidering machine for actuating the swing lever; the swing lever alternately engaging the main cam or the auxiliary cam to interlock solely therewith; whereby, when the fulcrum of the swing lever is displaced, the top dead point of the needle bar during normal vertical movement shifts up and down so as to adjust the length of stitch loops.

It is the primary object of the present invention to provide waiting means for an embroidering machine which, for example when cloths are changed or stitches are corrected, permits increased room above the sewing region to improve the accessibility for changing of cloths, inspection of stitches and others.

It is another object of the present invention to provide means for adjusting the length of a stitch loop in an embroidering machine, in which the loop length of the thread that forms stitches can be easily and positively changed.

The invention will become more apparent from the claims and the description as it proceeds in connection with the drawings.

DETAILED DESCRIPTION OF PREFERRED EMBODIMENTS

Figure 1:
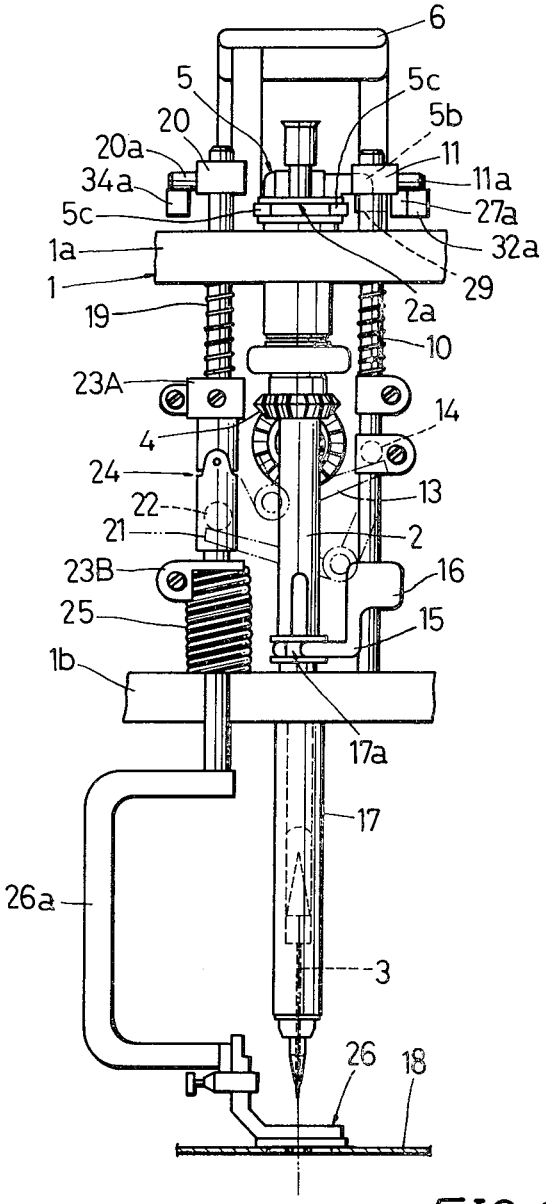
FIG. 1 is a front view of the essential parts of an embroidering machine incorporating a first embodiment of the present invention.
Figure 2:
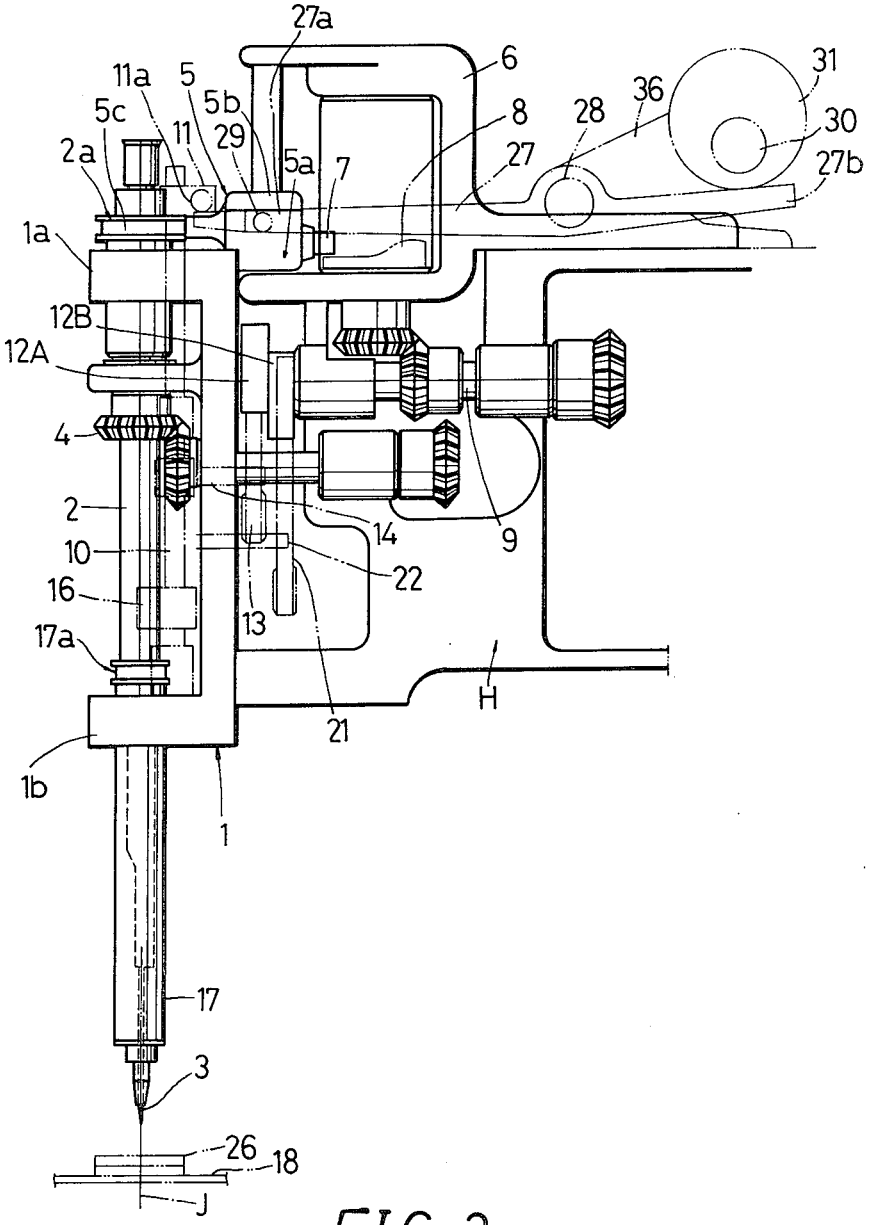
FIG. 2 is a side elevational view of FIG. 1.
Figure 3:
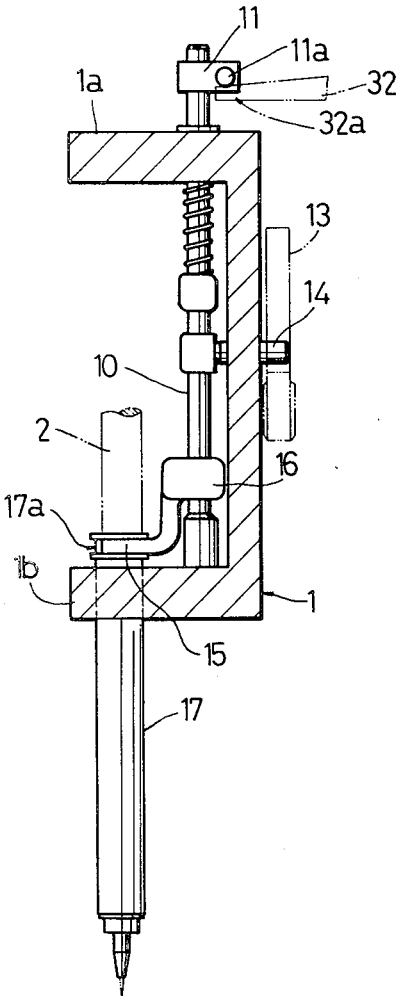
FIG. 3 is a side elevational view of the nipple mechanism of FIG. 1.
Figure 4:
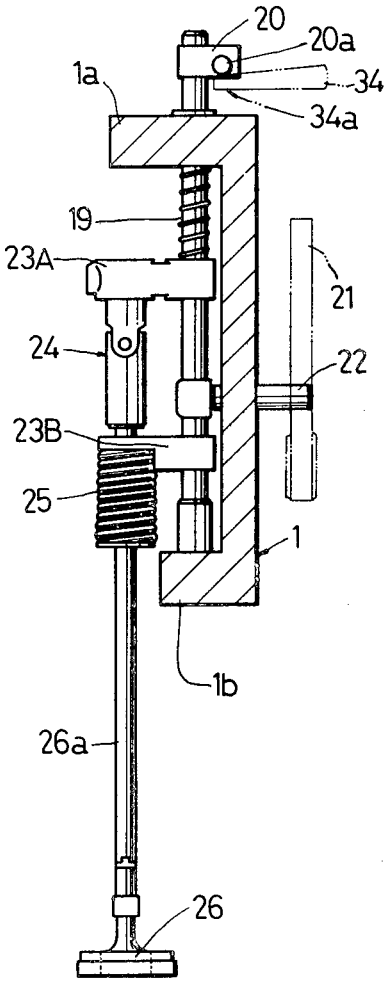
FIG. 4 is a side elevational view of the cloth pressing mechanism of FIG. 1.

Referring now to FIGS. 1 to 4 wherein the first embodiment of the present invention is shown, a support bracket 1 of recumbent U-shaped configuration in vertical section is provided at the forward end of a machine head H, and has upper and lower pieces 1*a* and 1*b*. A needle bar 2 is vertically movably supported by the upper and lower pieces 1*a* and 1*b* and has at the upper end portion thereof an engaging portion 2*a* having upper and lower flanges. A needle 3 is concentrically secured to the lower end of the needle bar 2. A bevel gear 4 is fitted on the mid portion of the needle bar 2. When the cloth to be embroidered is fed horizontally by a cloth feed mechanism (not shown), rotation of a driving motor (not shown) is transmitted through the bevel gear 4 to the needle bar 2 to rotate the same in the direction of cloth to be embroidered.

A holder 6 is disposed at the back of the upper end portion of the needle bar 2, and an elevating member 5 is vertically movably carried in the forward end of the holder 6. The elevating member 5 has a base 5*a*, a first engaging piece 5*b* extending sideways from the right (as viewed in FIG. 1) upper end of the base 5 and a forked nipping portion 5c projecting so as to nippingly engage with the engaging portion 2a of the needle bar 2. A main cam 8 is horizontally rotatably carried in the holder 6. A pin 7 is provided at the rear end of the base 5a projecting in such a way as to contact with the upper surface of the main cam 8. With this arrangement, the steady rotation of a main shaft 9 of the embroidering machine drives the main cam 8 for rotation which is converted through the pin 7 into vertical movement of the elevating member 5, and the needle bar 2 is vertically moved through the elevating member 5.

A nipple bar 10 is vertically movably carried by the upper and lower pieces 1a and 1b of the support bracket 1 in parallel relation to the needle bar 2 on the right hand (as viewed in FIG. 1). A second engaging piece 11 is secured to the upper end of the nipple bar 10. Numeral 13 designates a swing lever swingingly movable through rotation of a front cam 12A secured to the front end of the main shaft 9. A contact pin 14 transversely extends backwardly at the mid portion of the nipple bar 10 and is brought to bear on the swing lever 13 to vertically move the nipple bar 10 synchronously with the needle bar 2. A nipple holder 16 having a forked connecting portion 15 is secured to the lower end of the nipple bar 10.

A nipple 17 is fitted rotatably and vertically slidably on the lower portion of the needle bar 2, and is vertically movably carried by the lower piece 1b of the support bracket 1. The nipple 17 is of substantially cylindrical configuration and has at the upper end thereof an engaging portion 17a which is adapted to be engaged with the connecting portion 15 of the nipple holder 16 to connect the nipple 17 and the nipple bar 10 with each other so that the nipple 17 can be moved vertically together with the nipple bar 10. When the needle bar 2 is lowered, the needle 3 projects from under the lower end of the nipple 17 into the cloth and the nipple 17 is synchronously lowered to press the cloth, surrounding the needle location, against a feed plate 18. The feed plate 18 is disposed in contact with the lower surface of the cloth, being horizontally movable, and connected with the feed mechanism so as to feed the cloth around the needle location when the needle bar 2 moves upwardly.

A pressing bar 19 is vertically movably carried by the upper and lower pieces 1a and 1b of the support bracket 1 in parallel on the left hand (as viewed in FIG. 1) of the needle bar 2. A third engaging piece 20 is secured to the top end of the pressing bar 19. Numeral 21 designates a swing lever swingingly movable through rotation of a rear cam 12B provided in parallel at the back of the front cam 12A. A contact pin 22 transversely extends backwardly at the mid portion of the pressing bar 19 and is brought to bear on the swing lever 21 to vertically move the pressing bar 19 with the phase difference of 180 degrees in relation to the needle 3. There are provided, above and below the contact pin 22, upper and lower support pieces 23A and 23B transversely extending forwardly, respectively.

A universal joint 24 is movably fitted in the upper support piece 23A and also loosely received by the lower support piece 23B in such a manner as to be tilted relative to the support piece 23B. A resilient member 25 is connected to the lowermost end of the universal joint 24 and adapted to be resiliently transformed in the horizontal direction and restored centripetally through its resiliency. An annular presser foot 26 is connected through a connecting bar 26a to the lowermost end of the resilient member 25, and is placed in oppossed relation to the upper surface of the feed plate 18 in such a way that the center of the presser foot 26 is on the axis of rotation J of the needle 3. When the presser foot 26 is lowered through the universal joint 24 in connection with the pressing bar 19, the presser foot 26 presses the cloth around the needle location against the feed plate 18, and when the feed plate 18 moves horizontally, it is displaced in accordance with the movement of the feed plate 18 so as to feed the cloth around the needle location. When the presser foot 26 is moved upwardly in connection with the pressing bar 19, the presser foot 26 releases the cloth and is automatically restored centripetally to the axis of rotation J.

Figure 5:
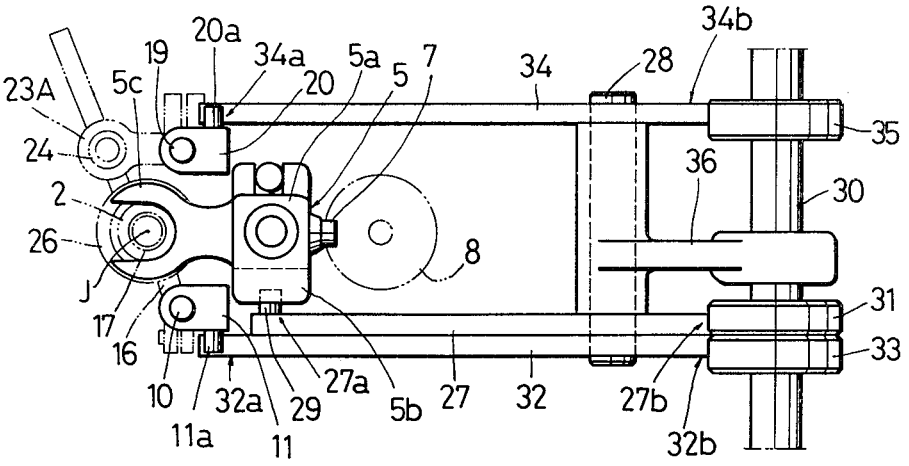
FIG. 5 is a top plan view of the waiting mechanism according to the first embodiment of the present invention.
Figure 6:
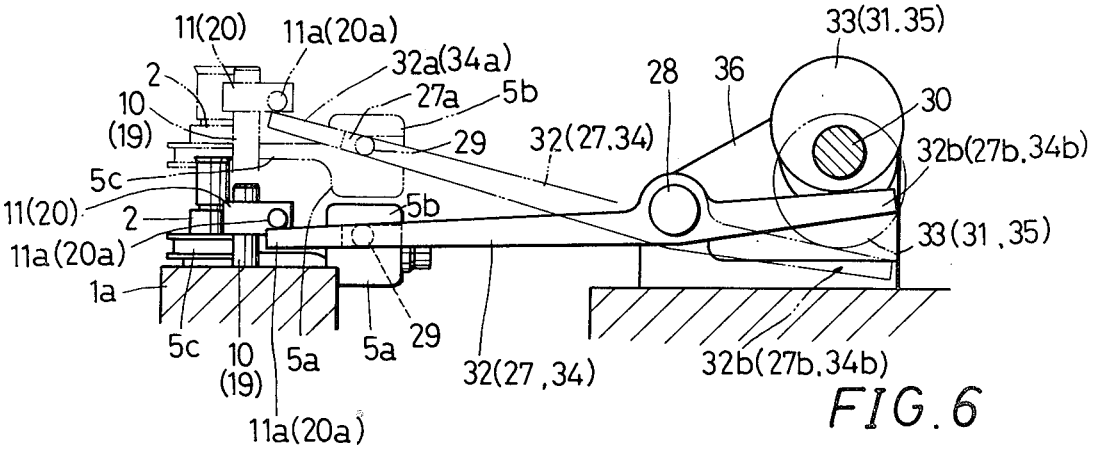
FIG. 6 is a side elevational view of FIG. 5.

Now the waiting mechanism for the needle 3, the nipple 17 and the presser foot 26 will be described with reference to FIGS. 5 and 6. A shaft 28 is disposed transversely around the upper end portion of the machine head H, and a needle waiting lever 27 is pivotally carried by the shaft 28. The needle waiting lever 27 contacts with the elevating member 5 in such a way that a pin 29 provided at the forward end 27a of the needle waiting lever 27 will be brought to bear on the lower surface of the first engaging piece 5b of the elevating member 5 when it is at the most lowered position. The rearmost end 27b of the needle waiting lever 27 is connected through a support arm 36 to the shaft 28 and is in contact with a first waiting cam 31 which is fitted on a driving shaft 30 controlled for rotation of 180 degrees at a time by a motor (not shown) driven for rotation when the sewing operation is stopped. When the rearmost end 27b of the lever 27 is pressed down through the rotation of the first waiting cam 31, the elevating member 5 is pressed upwardly by the forward end 27a of the lever 27, and the needle bar 2 moves upwardly to be held at its elevated position, and the needle 3 is lifted upwardly from its normal position. When the first waiting cam 31 is further rotated 180 degrees, the rearmost end 27b of the lever 27 moves upwardly. As the forward end 27a is lowered, the elevating member 5 is lowered to its normal position, and consequently the needle bar 2 is lowered to restore the needle 3 to its normal position for the subsequent sewing operation.

A nipple waiting lever 32 is pivotally carried by the shaft 28 in parallel relation to the needle waiting lever 27. The nipple waiting lever 32 contacts with the nipple bar 10 in such a way that the forward end 32a of the nipple waiting lever 32 will be brought to bear on a pin 11a of the second engaging piece 11 which is secured to the upper end portion of the nipple bar 10 when it is at the most lowered position. The rearmost end 32b of the lever 32 is in contact with a second waiting cam 33 fitted on the driving shaft 30 on the right hand of the first waiting cam 31. When the rearmost end 32 of the nipple waiting lever 32 is pressed down through rotation of the second waiting cam 33, the nipple bar 10 is pressed upwardly by the forward end 32a to be held at its elevated position, and the nipple 17 is lifted upwardly from its normal position. When the second waiting cam 33 is further rotated 180 degrees, the rearmost end 32b of the lever 32 is moved upwardly, and as the forward end 32a is lowered, the nipple bar 10 is lowered to restore the nipple 17 to its normal position for the subsequent sewing operation.

A presser foot waiting lever 34 is pivotally carried by the shaft 28 in parallel relation to the needle waiting lever 27 and the nipple waiting lever 32. The presser foot waiting lever 34 contacts with the pressing bar 19 in such a way that the forward end 34*a* of the lever 34 will be brought to bear on a pin 20*a* of the third engaging piece 20 which is secured to the upper end portion of the pressing bar 19 when it is at the most lowered position. The rearmost end 34*b* is in contact with a third waiting cam 35 fitted on the driving shaft 30 at the left hand of the first waiting cam 31. When the rearmost end 34*b* of the lever 34 is pressed down through rotation of the third waiting cam 35, the pressing bar 19 is pressed upwardly by the forward end 34*a* to be held at its elevated position, and the presser foot 26 is lifted upwardly from its normal position. When the third waiting cam 35 is further rotated 180 degrees, the rearmost end 34*b* of the lever 34 is moved upwardly, and as the forward end 34*a* is lowered, the pressing bar 19 is lowered to restore the presser foot 26 to its normal position for the subsequent sewing operation.

Now, the operation of the first embodiment thus constructed will be described. When the sewing operation is stopped, the first, the second and the third waiting cams 31, 33 and 35 are controlled for rotation to pivotally move the needle waiting lever 27, the nipple waiting lever 32 and the presser foot waiting lever 34, respectively, and the needle 3, the nipple 17 and the presser foot 26 are lifted upwardly from their normal positions to be held at their elevated positions. With this arrangement, when the sewing operation is stopped, the needle 3, the nipple 17 and the presser foot 26 are brought apart from the upper surface of the cloth around the needle location. Thus, the sewing condition and the waiting condition can be easily shifted to each other, thereby greatly improving the efficiency of the operations incidental to the embroidery sewing such as setting the cloth in and out of a tambour, as is well known in the art, inspecting the stiches and correcting incorrect stitches.

Figure 7:
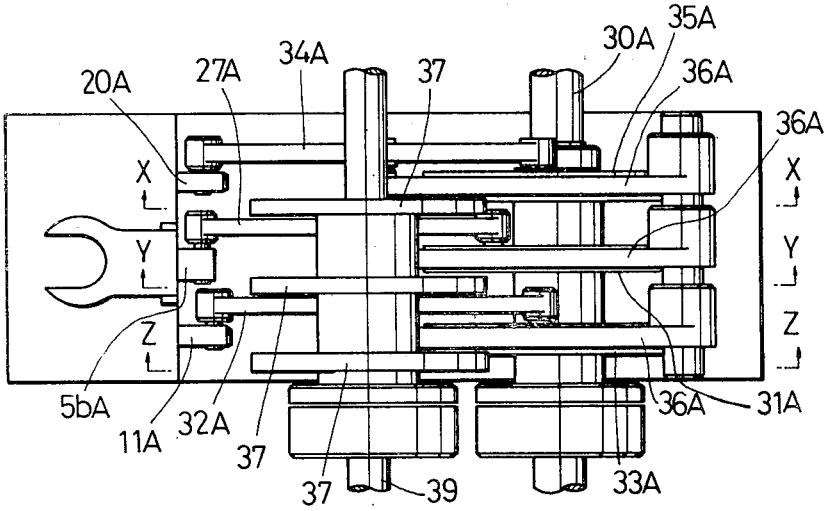
FIG. 7 is a top plan view of the waiting mechanism of a second embodiment of the present invention.
Figure 8:
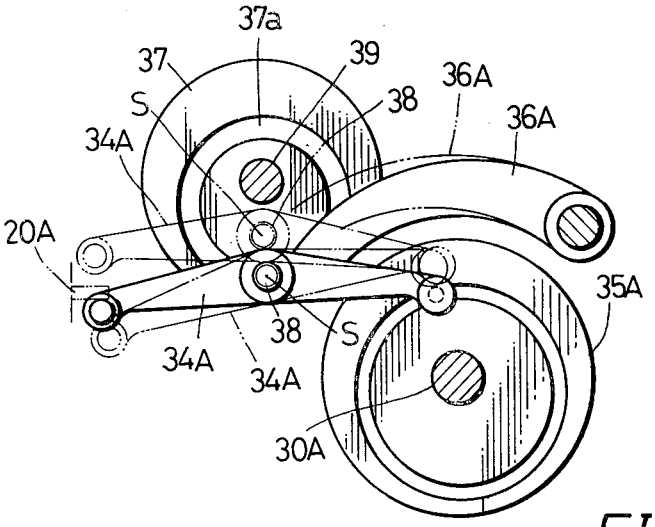
FIG. 8 is a view looking in the direction of arrows X—X of FIG. 7.
Figure 9:
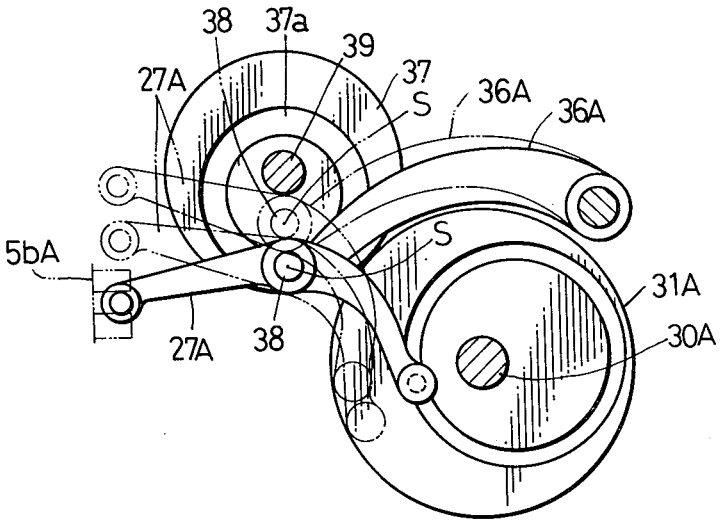
FIG. 9 is a view looking in the direction of arrows Y—Y of FIG. 7.
Figure 10:
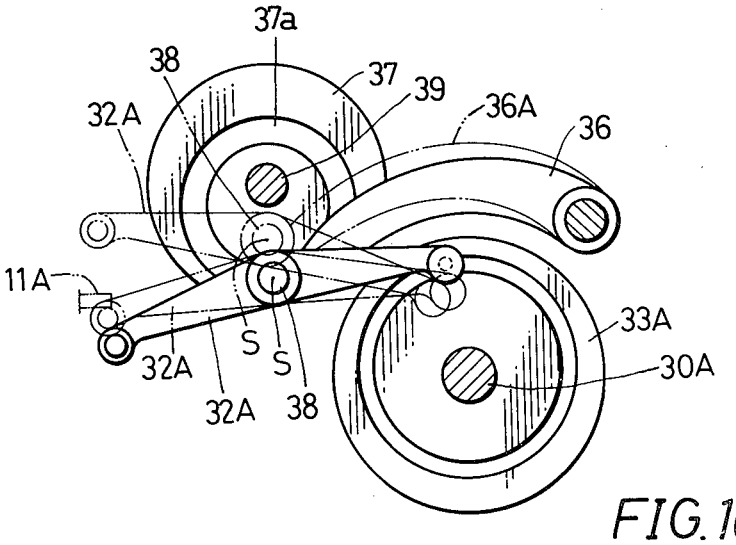
FIG. 10 is a view looking in the direction of arrows Z—Z of FIG. 7.
Figure 11:
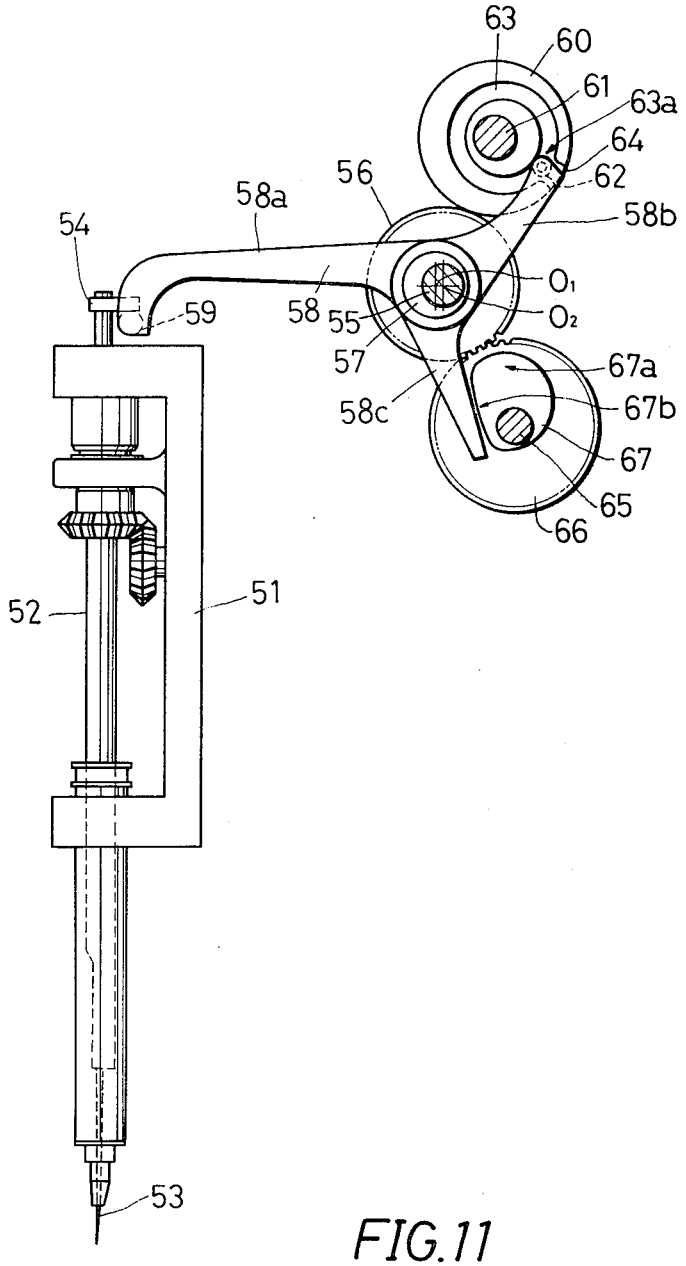
FIG. 11 is a diagrammatic side elevational view of the essential parts of a modified mechanism for raising the needle bar.
Figure 12:
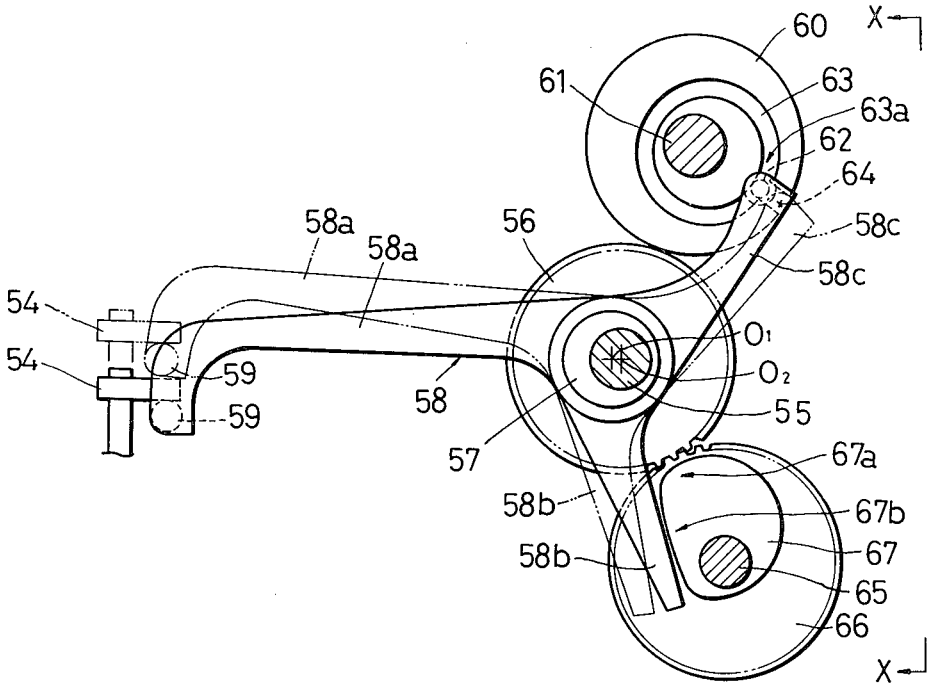
FIG. 12 is an enlarged side view of the mechanism of FIG. 11.
Figure 13:
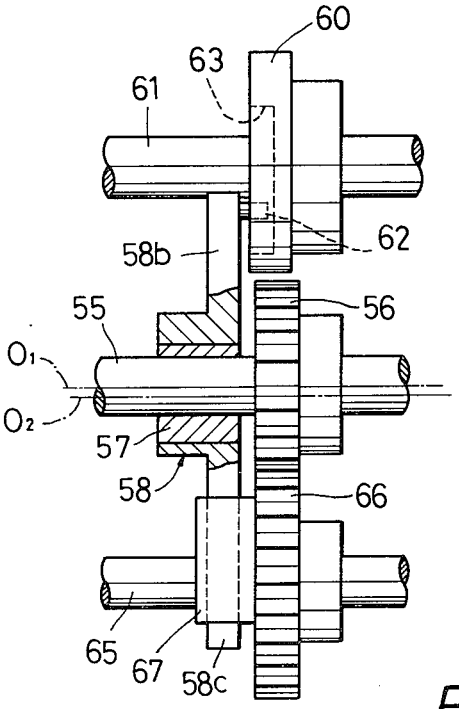
FIG. 13 is a view looking in the direction of arrows X—X of FIG. 12.
Figure 14:
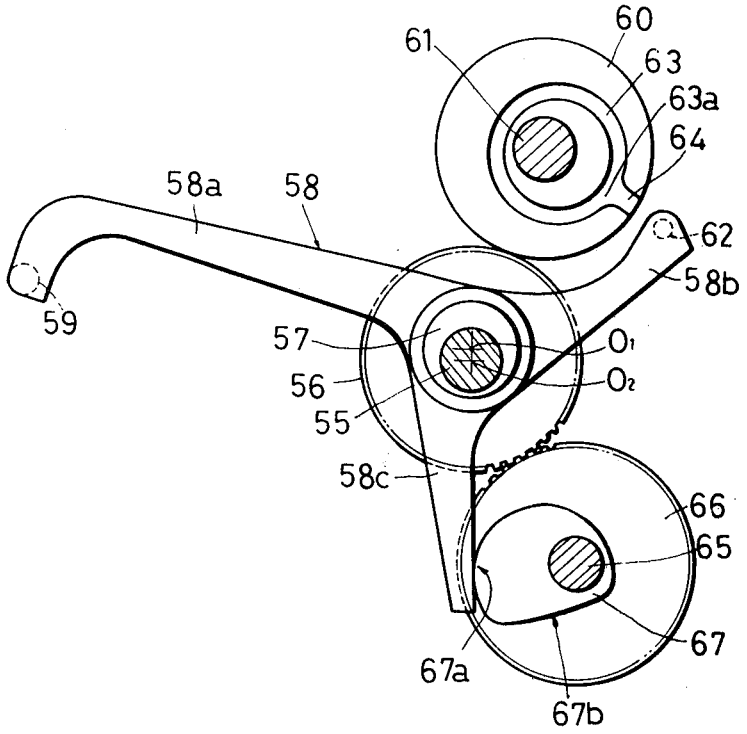
FIG. 14 is a side view similar to FIG. 12 illustrating the swing lever being displaced.

Now the second embodiment of the present invention will be described with reference to FIGS. 7 and 10. Like parts are given like reference numerals having A affixed thereto. Three support arms 36A are pivotally connected to the head H, as seen in FIG. 7, each of which support arms 36A having a support pin 38 at the forward end thereof. A needle waiting lever 27A, a nipple waiting lever 32A and a presser foot waiting lever 34A are each pivotally carried by the support pin 38. Three circular adjusting cams 37 are rotatably carried on shaft 39 which is disposed generally above the support arms 36A. Each of the adjusting cams 37 has a groove with which each of the support pins 38 is operatively engaged. As may be seen in FIGS. 8, 9 and 10, each of the waiting levers 27A, 32A and 34A is pivotally moved through rotation of the first waiting cam 31A, the second waiting cam 33A and the third waiting cam 35A all fitted on the driving shaft 30A, respectively. Pivotal movement of each of the waiting levers 27A, 32A and 34A permits the first engaging piece 5*b*A connected to the needle bar, the second engaging piece 11A connected to the nipple bar and the third engaging piece 20A connected to the pressing bar to move vertically. When the fulcra S of swing of the waiting levers 27A, 32A and 34A are vertically adjusted through rotation of the adjusting cams 37, the levels of vertical movements of the forward ends of the waiting levers 27A, 32A and 34A or the contacting positions with the needle bar, nipple bar and pressing bar are vertically adjusted.

As the operation of the second embodiment is almost the same as that of the first embodiment, the explanation will be omitted.

Referring to FIGS. 11 to 14, shown therein is a modified mechanism for raising the needle bar. Numeral 51 designates a support bracket disposed at the forward end of the machine head H. A vertically movable needle bar 52 is rotatably carried by the support bracket 51. A needle 53 is secured to the lowermost end of the needle bar 52, and an interlocking piece 54 is attached to the top end of the needle bar 52.

A transversely extending shaft 55 is rotatably carried in the upper portion of the machine head H, and an upper interlocking gear 56 is fitted on the shaft 55. An eccentric collar 57 of eccentrically cylindrical configuration is fitted on the shaft 55, the center $O_1$ thereof being displaced from the axis $O_2$ of the shaft 55.

A swing lever 58 is pivotally carried on the shaft 55 through the eccentric collar 57, the swing lever 58 idly receiving the eccentric collar 57 to pivot about the center $O_1$ of the eccentric collar 57. The swing lever 58 is a three-pronged member having a front arm 58*a*, an upper arm 58*b* and a lower arm 58*c*. The front arm 58*a* contacts with the interlocking piece 54 of the needle bar 52 through a lock pin 59 provided at the front end of the front arm 58*a*, and thereby the needle bar 52 is vertically moved through swinging movement of the swing lever 58.

Numeral 61 designates a driving shaft rotatably carried by the head H and extending transversely above the shaft 55. The driving shaft 61 is driven for rotation through steady rotation of a main shaft (not shown) of the embroidering machine. A main cam 60 is fitted on the driving shaft 61 in opposed relation to the upper arm 58*b* of the swing lever 58, and has on the side surface thereof an annular cam groove 63 eccentrically provided to receive a guide pin 62 projecting from the extreme end of the upper arm 58*b* so as to impart steady swinging movement of the upper arm 58*b*. The cam groove 63 communicates with a clearance groove 64 which is provided at the most eccentric portion 63*a* corresponding to the top dead point of the needle bar 51 and is outwardly opening to allow the guide pin 62 to disengage from main cam 60 through the cam groove 63 when the guide pin 62 is guided to the most eccentric portion 63*a*. When the guide pin 62 is lifted outwardly from the clearance groove 64, the swing lever 58 is released to disengage from the main cam 60.

Numeral 65 designates an interlocking shaft 65 rotatably carried by the head H and extending transversely below the shaft 55. The interlocking shaft 65 is controlled for rotation by a control motor (not shown), such as a pulse motor, which is driven when the needle bar 52 moves upwardly to its top dead point.

A lower interlocking gear 66 is fitted on the interlocking shaft 65 in such a way as to mesh with the upper interlocking gear 56 to rotate the shaft 55. An auxiliary cam 67 is fitted on the interlocking shaft 65 in opposed relation to the lower arm 58*c* of the swing lever 58 and rotatable together with the lower interlocking gear 66. The auxiliary cam 67 has a convex portion 67*a* and a clearance portion 67*b*. When the main cam 60 is rotated until the most eccentric portion 63*a* of the cam groove 63 faces the guide pin 62 of the upper arm 58*b*, the lower arm 58*c* is pushed in the clockwise direction by the convex portion 67*a* through rotation of the control motor to withdraw the guide pin 62 outwardly from the main cam 60 through the clearance groove 64, and to thereby bring the swing lever 58 out of contact with the main cam 60. Thus, the top dead point of the swing lever 58 is displaced to thereby lift the needle bar 52 upwardly from its top dead point during normal vertical movement. The clearance portion 67*b* permits swinging movement of the lower arm 58*c* during the normal swinging movement of the swing lever 58 to release the swing lever 58 from the auxiliary cam 67. Thus, the swing lever 58 is brought to bear on the main cam 60 or the auxiliary cam 67 alternatively to be interlocked therewith. When the auxiliary cam 67 is rotated through rotation of the control motor to push the lower arm 58*c* by the convex portion 67*a*, the upper arm 58*b* is removed from the main cam 60 and subsequently the needle bar 52 is lifted upwardly. Further, when the clearance portion 67*b* faces the lower arm 58*c*, rotation of the lower interlocking gear 66 which is rotated together with the auxiliary cam 67 is transmitted through the upper interlocking gear 56 to the shaft 55. The shaft 55 is then rotated and at the same time, the center $O_1$ of swing of the swing lever 58 is displaced through the rotation of the eccentric collar 57 (See FIG. 14.), so that the top dead point and the bottom dead point of the needle bar 52 are vertically moved.

Thus, simple movement of the top dead point of the needle bar 52 allows ready change of the space relative to the lower sewing mechanism, such as a looper, disposed below in opposed relation to the needle 53 so as to adjust the loop length of the stitch formed by vertical movement of the needle 53.

When the cloth is fed horizontally for embroidering, travel of the cloth and loop length determined by the vertical movement of the needle 53 are adjusted, and horizontal feed of the cloth and the displacement of the top dead point of the needle bar 52 take place at the same time so as to eliminate improper tension applied on the thread when the stitch is formed, with the advantageous result of achievement of regular and accurate embroidering.

While the invention has been described with reference to a few preferred embodiments thereof, it is to be understood that modifications or variations may be easily made without departing from the scope of this invention which is defined by the appended claims.

What is claimed is:

1. For use in an embroidering machine having a head; a needle bar vertically movably carried in the forward end portion of said head and having a needle operatively connected thereto for forming embroidery stitches on a cloth; a nipple vertically movably carried in the forward end portion of said head in parallel relation with said needle bar, said nipple slidably receiving said needle bar therewithin and adapted to be lowered synchronously when said needle bar is lowered so as to press the cloth at the needle location where said needle passes through the cloth; and a presser foot vertically movably carried in the forward end portion of said head in parallel relation with said needle bar and said nipple, said presser foot, when said needle is raised, being adapted to be displaced horizontally so as to horizontally feed the cloth while pressing the cloth around the needle location, waiting means comprising lifting means mechanically coupled to the top portion of said head and adapted to lift each of said needle bar, said nipple and said presser foot upwardly so as to bring each to a waiting position when the sewing operation is stopped.

2. The waiting means as defined in claim 1 wherein said lifting means comprises:

a needle waiting lever pivotally connected to said head for raising said needle bar when the sewing operation is stopped;

a first waiting cam rotatably connected to said head and mechanically coupled to a source of rotational drive of said embroidering machine, said first waiting cam being engageable with said needle waiting lever;

a nipple waiting lever pivotally connected to said head for raising said nipple when the sewing operation is stopped;

a second waiting cam rotatably connected to said head and mechanically coupled to a source of rotational drive of said embroidering machine, said second waiting cam being engageable with said nipple waiting lever;

a presser foot waiting lever pivotally connected to said head for raising said presser foot when the sewing operation is stopped; and a third waiting cam rotatably connected to said head and mechanically coupled to a source of rotational drive of said embroidering machine, said third waiting cam being engageable with said presser foot waiting lever.

3. The waiting means as defined in claim 1 wherein said lifting means comprises:

a needle waiting lever pivotally connected to said head for raising said needle bar when the sewing operation is stopped;

a first adjusting cam rotatably connected to said head and mechanically coupled to a source of rotational drive of said embroidering machine, said first adjusting cam being engageable with the fulcrum of said needle-waiting lever, said first adjusting cam, when being rotated, vertically displacing said fulcrum of said needle waiting lever so as to adjust the upward movement from the top dead point of said needle;

a nipple waiting lever pivotally connected to said head for raising said nipple when the sewing operation is stopped;

a second adjusting cam rotatably connected to said head and mechanically coupled to a source of rotational drive of said embroidering machine, said second adjusting cam being engageable with the fulcrum of said nipple waiting lever, said second adjusting cam, when being rotated, vertically displacing said fulcrum of said nipple waiting lever so as to adjust the upward movement from the top dead point of said nipple;

a presser foot waiting lever pivotally connected to said head for raising said presser foot when the sewing operation is stopped; and a third adjusting cam rotatably connected to said head and mechanically coupled to a source of rotational drive of said embroidering machine, said third adjusting cam being engageable with the fulcrum of said presser foot waiting lever, said third adjusting cam, when being rotated, vertically displacing said fulcrum of said presser foot waitng lever so as to adjust the upward movement from the top dead point of said presser foot.

4. The waiting means as defined in claim 1 wherein said lifting means comprises:

a swing lever pivotally connected to said head for raising said needle bar when the sewing operation is stopped, said swing lever having a fulcrum of swing adapted for displacement;

a main cam rotatably connected to said head and mechanically coupled to a source of rotational drive of said embroidering machine for normally reciprocating said needle bar; and an auxiliary cam rotatably connected to said head and mechanically coupled to a source of rotational drive of said embroidering machine for actuating said swing lever;

said swing lever alternately engaging said main cam or said auxiliary cam to interlock solely therewith;

whereby, when said fulcrum of said swing lever is displaced, the top dead point of said needle bar during normal vertical movement shifts up and down so as to adjust the length of stitch loops.

* * * * *